US011108181B2

(12) United States Patent
Lane

(10) Patent No.: US 11,108,181 B2
(45) Date of Patent: Aug. 31, 2021

(54) VIBRATION RESISTANT HIGH-POWER ELECTRICAL CONNECTOR

(71) Applicant: Carlisle Interconnect Technologies, Inc., Kent, WA (US)

(72) Inventor: Bruce Lane, Tempe, AZ (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 10 days.

(21) Appl. No.: 16/693,179

(22) Filed: Nov. 22, 2019

(65) Prior Publication Data

US 2020/0169021 A1 May 28, 2020

Related U.S. Application Data

(60) Provisional application No. 62/772,024, filed on Nov. 27, 2018.

(51) Int. Cl.

| | |
|---|---|
| ***H01R 24/86*** | (2011.01) |
| ***H01R 13/04*** | (2006.01) |
| ***H01R 13/10*** | (2006.01) |
| ***H01R 24/28*** | (2011.01) |

(52) U.S. Cl.

CPC ..... *H01R 13/04* (2013.01); *H01R 13/10* (2013.01); *H01R 24/28* (2013.01); *H01R 24/86* (2013.01)

(58) Field of Classification Search

CPC ..... H01R 13/04; H01R 13/10; H01R 13/22; H01R 13/533; H01R 24/28; H01R 24/86; H01R 4/302; H01R 33/7664; H01R 33/975

USPC ..... 439/382

See application file for complete search history.

(56) References Cited

U.S. PATENT DOCUMENTS

| | | | | |
|---|---|---|---|---|
| 1,552,262 A * | 9/1925 | Betz | H01R 13/04 | 439/732 |
| 4,054,346 A * | 10/1977 | Schultz | H01J 5/60 | 439/366 |
| 4,148,541 A * | 4/1979 | Marks | H01R 33/7678 | 313/318.01 |
| 2020/0036126 A1* | 1/2020 | Kobayashi | H01R 13/04 | |

* cited by examiner

*Primary Examiner* — Edwin A. Leon
*Assistant Examiner* — Milagros Jeancharles
(74) *Attorney, Agent, or Firm* — Stoel Rives LLP

(57) ABSTRACT

The disclosure relates to an electrical connector system including a first connector having a plurality of cantilevered fingers disposed along a mating face thereof, and a second connector having a conductive central core including a plurality of open slots designed for receiving the plurality of cantilevered fingers. When the connectors are mated, each cantilevered finger sits within a respective slot at a sufficient depth therein to improve vibration resistance of the mated electrical connector.

18 Claims, 2 Drawing Sheets

VIBRATION RESISTANT HIGH-POWER ELECTRICAL CONNECTOR

RELATED APPLICATION DATA

This application is a nonprovisional of and claims the benefit under 35 U.S.C. § 119(e) of U.S. Provisional Patent Application No. 62/772,024, filed Nov. 27, 2018, the disclosure of which is incorporated by reference herein in its entirety.

TECHNICAL FIELD

The field of this disclosure relates generally to electrical connectors and, in particular, to a streamlined electrical contact design for improved vibration resistance and overall functionality for high-power electrical connectors.

BACKGROUND

Electrical connectors are commonly used to connect electronic devices for facilitating communication and information transfer. Electrical connectors may be used in a variety of applications, such as for high-speed data transmission, for handling large electrical loads in high-power applications, or in other suitable settings. Depending on the use, such connectors may be subjected to a variety of harsh environmental conditions. For example, electrical connectors may experience large vibration and mechanical shock, extreme moisture, high external electrical and magnetic interference, and pressure changes, each of which can detrimentally affect overall performance. While the connectors may not typically experience all these conditions at once, high-power electrical connectors commonly operate in high-vibration environments and should therefore be designed to resist large vibrations to maintain proper performance during use.

Because degraded performance of an electrical connector adversely impacts the ability of a system to transfer energy, the present inventor has recognized a need for a robust electrical contact design capable of handling high levels of vibration, particularly in demanding industries such as aerospace systems, aircraft electronic systems, and other high-power applications. The present inventor has also recognized a need for such an electrical connector having features to promote self-alignment and secure retention of electrical contacts for improved vibration resistance. Additional aspects and advantages will be apparent from the following detailed description of preferred embodiments, which proceeds with reference to the accompanying drawings.

DETAILED DESCRIPTION OF EXAMPLE EMBODIMENTS

With reference to the drawings, this section describes various embodiments of an improved contact design for electrical connectors and its detailed construction and operation. Throughout the specification, reference to "one embodiment," "an embodiment," or "some embodiments" means that a particular described feature, structure, or characteristic may be included in at least one embodiment of the electrical connector. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

The following describes example embodiments of an electrical contact design for electrical connectors that may be used in an aerospace environment and/or for other suitable applications, such as aircraft electronic systems. In the following description, certain components of the electrical connector system are described in detail, while in some instances, well-known structures, materials, or operations are not shown or not described in detail to avoid obscuring more pertinent aspects of the embodiments. It should be understood that one having ordinary skill in the art understands how to incorporate the features of the electrical contact design described below into a functional electrical connector, even though certain aspects of the electrical connectors are not further described herein. Accordingly, the following description focuses primarily on the improved features of the electrical contact design.

With general reference to the figures, the following description relates to a high-power electrical connector system having a pin and socket contact design for improved vibration resistance. As further described in detail below, the pin and socket contacts are designed with mating fingers or flanges to create multiple contact surfaces between the pin and socket contacts for aiding in aligning the contacts during the mating process, and for minimizing lateral and rotational movement of the contacts after assembly. The reduction in movement helps prevent unwanted electrical bounce preventing arcing between the respective contacts, resulting in improved overall performance for the electrical connector. In addition, this configuration creates an increased contact surface area, as compared to conventional designs, which helps prevent heat concentration between the contacts at the contact interface. Additional details, advantages, and features of the electrical contact design are provided below with reference to the figures.

Figure 1:
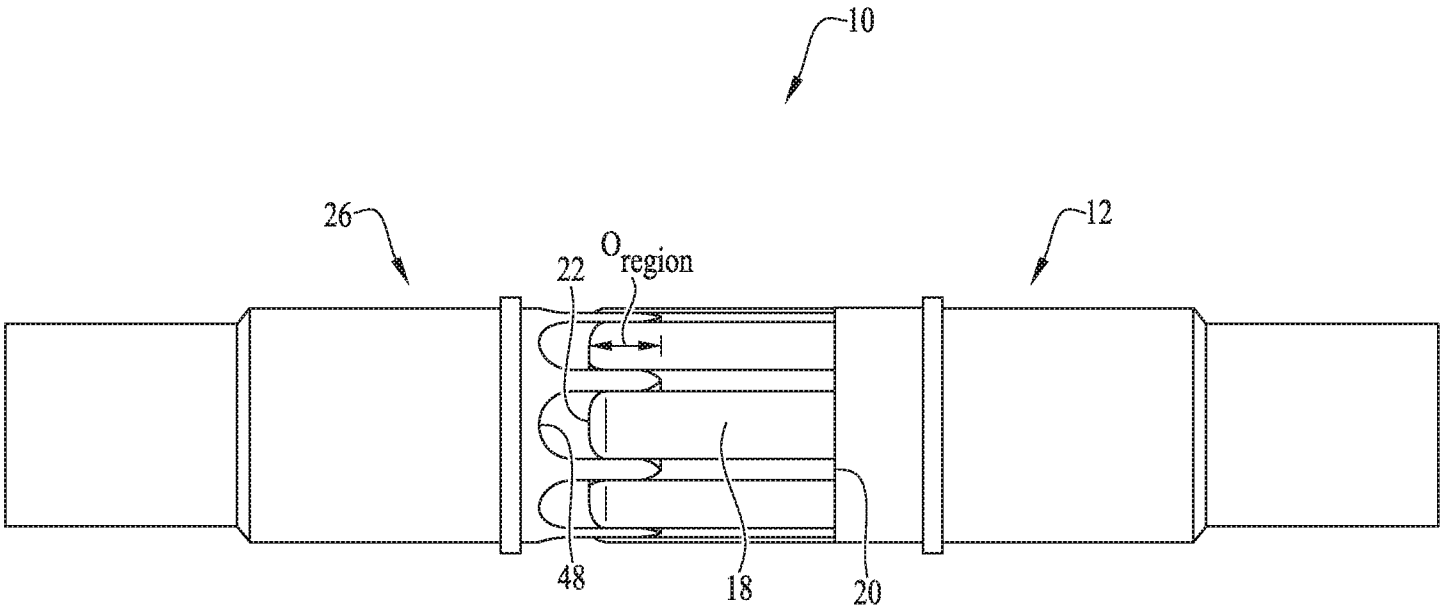
FIG. 1 is a schematic view of a pair of electrical connectors illustrating mated pin and socket electrical contacts in accordance with one embodiment.

FIG. 1 illustrates a connector system 10 including a pair of mated electrical connectors 12, 26 in accordance with one embodiment. With reference to FIG. 1, the connector system 10 according to one embodiment includes a first connector 12 that interfaces and mates with a second connector 26 to create an electrical connection between two cables (not shown). Before proceeding with a description of the connectors 12, 26, it is noted that the illustration of the electrical connectors 12, 26 in FIG. 1 does not further illustrate interior components, such as wiring, insulation, and other common components of the respective connectors. These features are not illustrated to avoid obscuring more pertinent aspects of the embodiment. To establish a frame of reference, the following briefly describes a common arrangement of internal wiring for electrical connectors and highlights potential issues that may arise depending on the wire arrangement.

Briefly, a standard power cable for an electrical connector commonly includes twisted copper wires, each wire being covered with appropriate insulating material to keep adjacent wires electrically isolated from one another. Each of the wire is terminated at one end by an individual contact (e.g., a socket contact or a pin contact), which are typically arranged parallel to one another in the pin or socket connector. With general reference to FIGS. 1-3, the following description focuses on the design and arrangement of the pin and socket contacts of the respective pin and socket connectors to achieve a connector design with improved vibration resistance and improved current transfer capability.

The following section provides additional details relating specifically to the features of the first connector 12 and the second connector 26. The discussion begins with details relating first to the first connector 12 with reference to FIG. 2, followed by a description of the second connector 26 with reference to FIG. 3, and concludes with a discussion focusing on how the respective components interact with one another when the connectors 12, 26 are mated.

Figure 2:
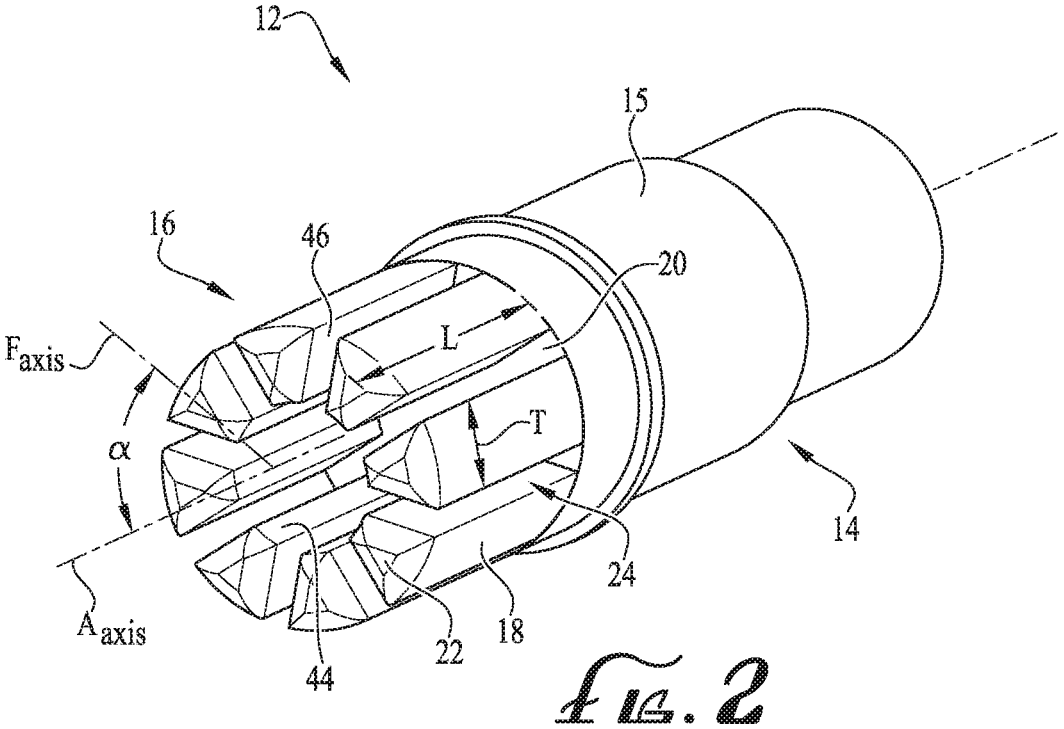
FIG. 2 is a schematic view of a socket contact of the embodiment illustrated in FIG. 1.

FIG. 2 illustrates an example embodiment of a first connector 12 of the connector system 10. With reference to FIG. 2, the first connector 12 includes a tubular body or housing 14 having an exterior surface 15 extending around the circumference of the body 14. The connector 12 further includes a mating face 16 disposed along one end of the body 14, the mating face 16 including a substantially planar end surface 20 arranged generally perpendicular to the exterior surface 15 of the body 14. A plurality of cantilevered fingers 18 extend outwardly from the end surface 20, the fingers 18 being arranged generally parallel relative to a central longitudinal axis A traversing the body 14 of the first connector 12.

In one embodiment, the fingers 18 are formed as integral components of the body 14, the fingers 18 extending outwardly from the end surface 20 and having an opposite free end 22. The cantilevered fingers 18 are separated from one another via a small gap or slot 24 that is preferably of equal size between all the fingers 18 to ensure that the fingers 18 are distributed evenly along the end surface 20. For example, in one embodiment, the first connector 12 may include a total of eight equally-spaced fingers 18 extending from the end surface 20 of the body 14, where each of the fingers 18 is positioned at an angle $\alpha$ of approximately 45°, where angle $\alpha$ is measured as the angle formed between an axis F crossing a midpoint of the finger 18 and intersecting with the central axis A of the connector 12 (see FIG. 2). The fingers 18 preferably include a thickness T and length L designed to accommodate desired flexion characteristics or profiles of the fingers 18 when mated with the second connector 26 as further described in detail below with reference to FIG. 3.

One having ordinary skill in the art understands that the respective thickness T and length L of the fingers 18 may be varied to accommodate any other suitable number of fingers 18 in the first connector 12. For example, in other embodiments, the first connector 12 may include as few as four individual fingers 18 or as many as twelve fingers 18, depending on the size of the electrical connector system 10 and the desired thickness T of the fingers 18. While the figures and disclosure describe an embodiment with eight fingers 18, it should be understood that the illustrated embodiment is not intended to be limiting, and that embodiments with a different number of fingers are encompassed by the disclosure herein. Preferably, in embodiments with more or fewer fingers than eight as described with reference to FIG. 2, the fingers 18 are arranged with equal spacing on the end surface 20 such that the angle $\alpha$ is equal for each respective finger 18. For example, in one embodiment with six fingers 18, the angle $\alpha$ is preferably 60°. Similarly, in another embodiment with ten fingers 18, the angle $\alpha$ is preferably 36°

Figure 3:
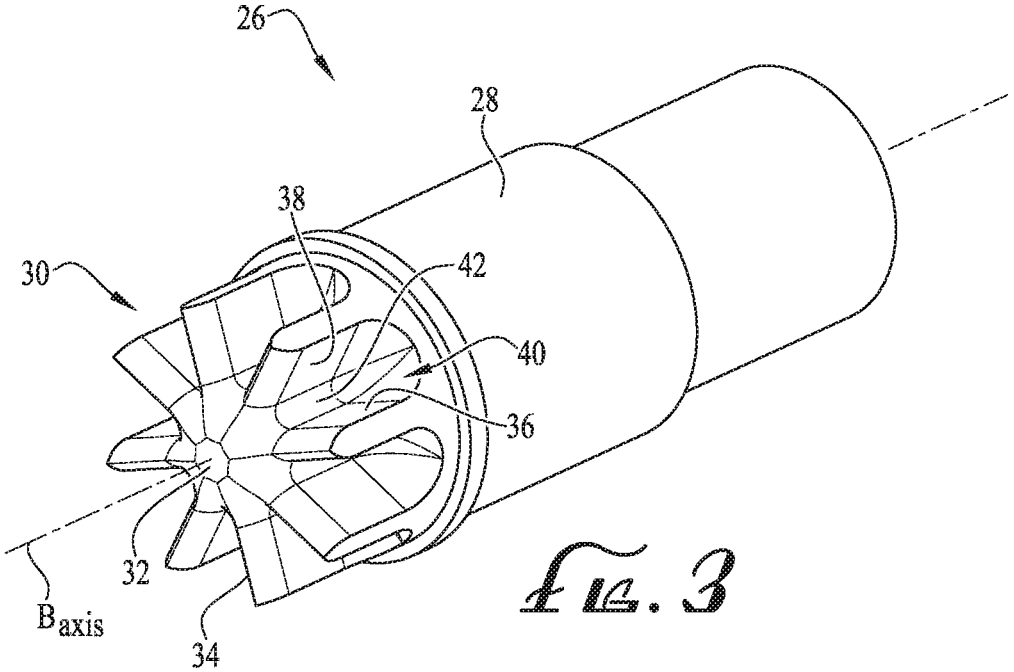
FIG. 3 is a schematic view of a pin contact of the embodiment illustrated in FIG. 1.

FIG. 3 illustrates an example embodiment of a second connector 26 of the electrical connector system 10. The second connector 26 includes a generally tubular body or housing 28 having an exterior surface 29 extending around the circumference of the body 28. The connector 26 further includes a mating face 30 disposed along one end of the body 28, the mating end 30 including a conductive central core 32 extending from the body 28 along an axis B of the second connector 26. A plurality of conductive fins 34 radiate outwardly from the core 26 toward a peripheral end or boundary of the second connector 26, where the fins 34 are comprised of vertical side walls (e.g., side walls 36, 38) extending from the body 28 and disposed generally parallel to the vertical axis B. The central core 32 and the fins 34 collectively create a plurality of physically separate cavities or slots 40 on the mating face 30 of the second connector 26. As illustrated in FIG. 3, each of the slots 40 is bounded by an exterior surface 42 of the central core 32 and the side walls 36, 38 from the adjacent fins 34. The slots 40 are open along their respective lateral ends (e.g., an end directly opposite the exterior surface 42) and along their respective tops. The number of slots 40 incorporated into the mating face 30 of the second connector 26 is equal to the number of fingers 18 incorporated into the first connector 12. Preferably, each slot 40 is sized and dimensioned to accommodate and receive a portion of a corresponding finger 18 from the first connector 12 when the connectors 12, 26 are mated as illustrated in FIG. 1.

With collective reference to FIGS. 1-3, the following describes an example mating process of the electrical connector system 10. In one example process, the first connector 12 and second connector 26 are arranged such that their respective mating faces 16, 30 face one another. Thereafter, the connectors 12, 26 are brought together until each one of the fingers 18 of the first connector 12 is aligned with a respective slot 40 of the second connector 26.

With reference to FIG. 2, each of the fingers 18 includes an interior surface 44 designed to sit against the exterior surface 42 of the central core 32 when the connectors 12, 26 are mated. Accordingly, the interior surface 44 of the fingers 18 may be designed (e.g., curved, angled, etc.) in any suitable manner that corresponds with the shape or curvature of the exterior surface 42 of the central core 32 to facilitate assembly and improve the mechanical connection between the connectors 12, 26. Similarly, the side surfaces 46 of the fingers 18 may be designed in any suitable matter to correspond with the dimensions of the side walls 36, 38 of the conductive fins 34 of the second connector 26. In this arrangement, when the connectors 12, 26 are mated, the fingers 18 of the first connector 12 slide into the corresponding slots 40 of the second connector 26, with the interior surface 44 of the fingers 18 abutting the exterior surface 42 of the central core 32, and the side surfaces 46 of the fingers 18 seated against the respective side walls 36, 38 of the fins 34. In this configuration, the conductive core 26 and fins 28 provide additional physical support to retain and secure the fingers 18 in a desired alignment within the slots 30 and minimize lateral and rotational movement of the connectors 12, 26.

As illustrated in FIG. 1, in some embodiments, the free end 22 of the finger 18 may be spaced apart from a bottom surface 48 of the slot 40, such that the fingers 18 are not entirely seated against the bottom surface 48 of the slot 40 when the connectors 12, 26 are mated. In other embodiments, the respective dimensions of the fingers 18 and the depth of the slot 40 may be varied to achieve more of a flush connection as desired. To create a secure fit between the connectors 12, 26, the fins 34 of the second connector 26 and the fingers 18 of the first connector 12 are preferably designed such that there is a sufficient overlap region O, measured as the distance from the free end 22 of the fingers 18 to a corresponding terminal endpoint where the side walls 36, 38 contact the fingers 18 (see FIG. 1). In some embodiments, the overlap region O measures at least 0.001 inches. In other embodiments, the range of the overlap region O may span from 0.001 inches to 0.01 inches as desired. In still other embodiments, the range of the overlap region O may be larger as desired. In yet other embodiments, the range of the overlap region O may correspond to between 20%-40% of the overall length L of the fingers 18. As noted previously, the overlap between the fingers 18 and fins 34 helps ensure that the connectors 12, 26 are sufficiently secured to promote optimal performance for the electrical connector system 10.

The disclosed subject matter provides details for an electrical connector system having a streamlined design for use in aerospace and other suitable applications. The electrical connector system is designed to improve vibration resistance for electrical connectors, including high-power electrical connectors. As described, the configuration of the electrical connector system 10 creates multiple contact surfaces between the connectors 12, 26, which helps prevent lateral movement between the contacts when the connectors are mated. As mentioned previously, preventing vibrations between the contacts help minimize lateral chattering or arcing between respective contacts. Further the multiple contact surfaces result in an electrical connector design where the contact surfaces exceed twice the area of the cross-sectional area of the wire gage, which helps prevent heating from occurring at the interface of the contacts. Moreover, the design allows for the cross-sectional area of the pin contact around the contact surfaces to exceed that of the cross-sectional area of the wire gage. Finally, the socket contact cross-sectional area around the contact surfaces also exceeds that of the cross-sectional area of the wire gage.

Although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable. The terms and descriptions used above are set forth by way of illustration only and are not meant as limitations. It will be obvious to those having skill in the art that many changes may be made to the details of the above-described embodiments without departing from the underlying principles of the invention. Those having skill in the art should understand that other embodiments than those described herein are possible.

The invention claimed is:

1. An electrical connector system comprising:

a first connector having a body and a first mating face, the mating face including a plurality of cantilevered fingers extending outwardly from a first surface thereof, each of the plurality of cantilevered fingers having a free end opposite the first surface, wherein each cantilevered finger is spaced apart from an adjacent cantilevered finger by a gap; and a second connector having a second mating face including a conductive central core and a plurality of fins radiating outwardly from the central core, the fins forming a plurality of slots equal in number to the plurality of cantilevered fingers of the first connector;

wherein, when the first and second connectors are mated, each cantilevered finger of the plurality of cantilevered fingers is seated within a corresponding slot formed by the fins of the second connector, each cantilevered finger and respective fins defining an overlap region measured from the free end of the cantilevered finger to a corresponding terminal endpoint of the respective fins, the overlap region having a length ranging between 0.001 inches and 0.01 inches, and wherein the cantilevered fingers, slots, and fins cooperate to minimize lateral and rotational movement of the fingers to improve vibration resistance of the electrical connector system.

2. The electrical connector system of claim 1, wherein the body of the first connector includes an exterior surface and wherein the first surface of the first connector is disposed generally orthogonal to the exterior surface.

3. The electrical connector system of claim 1, wherein each cantilevered finger of the first connector further includes an interior surface, wherein the central core of the second connector includes an exterior surface, and wherein the interior surface of the cantilevered finger abuts against the exterior surface of the central core when the first and second connectors are mated.

4. The electrical connector system of claim 1, wherein a first fin of the plurality of fins includes a first side wall, and wherein a second fin of the plurality of fins adjacent the first fin includes a second side wall, the first and second side walls each defining a boundary for one slot of the plurality of slots.

5. The electrical connector system of claim 4, wherein an exterior surface of the central core extends between the first side wall of the first fin and the second side wall of the second fin.

6. The electrical connector system of claim 4, wherein each cantilevered finger is disposed between the first side wall and the second side wall of the slot.

7. The electrical connector system of claim 1, wherein each cantilevered finger is arranged at an angle relative to a longitudinal axis of the first electrical connector, wherein the angle is equal for each cantilevered finger of the plurality of cantilevered fingers.

8. The electrical connector system of claim 1, wherein the gap separating each cantilevered finger from an adjacent cantilevered finger is equal for all cantilevered fingers of the plurality of cantilevered fingers.

9. The electrical connector system of claim 1, wherein the free end of each cantilevered finger of the first connector is spaced apart from a bottom surface of each corresponding slot of the second connector when the first and second connectors are mated.

10. An electrical connector system comprising:

a first connector having a body and a first mating face, the mating face including a plurality of cantilevered fingers extending outwardly from a first surface thereof, each of the plurality of cantilevered fingers having a free end opposite the first surface, wherein each cantilevered finger is spaced apart from an adjacent cantilevered finger by a gap; and a second connector having a second mating face including a conductive central core and a plurality of fins radiating outwardly from the central core, the fins forming a plurality of slots equal in number to the plurality of cantilevered fingers of the first connector;

wherein, when the first and second connectors are mated, each cantilevered finger of the plurality of cantilevered fingers is seated within a corresponding slot formed by the fins of the second connector, each cantilevered finger and respective fins defining an overlap region measured from the free end of the cantilevered finger to a corresponding terminal endpoint of the respective fins, the overlap region having a length ranging between 20% to 40% of an overall length of the cantilevered finger as measured from the first surface of the mating face to the free end, and wherein the cantilevered fingers, slots, and fins cooperate to minimize lateral and rotational movement of the fingers to improve vibration resistance of the electrical connector system.

11. The electrical connector system of claim 10, wherein the body of the first connector includes an exterior surface and wherein the first surface of the first connector is disposed generally orthogonal to the exterior surface.

12. The electrical connector system of claim 10, wherein each cantilevered finger of the first connector further includes an interior surface, wherein the central core of the second connector includes an exterior surface, and wherein the interior surface of the cantilevered finger abuts against the exterior surface of the central core when the first and second connectors are mated.

13. The electrical connector system of claim 10, wherein a first fin of the plurality of fins includes a first side wall, and wherein a second fin of the plurality of fins adjacent the first fin includes a second side wall, the first and second side walls each defining a boundary for a slot of the plurality of slots.

14. The electrical connector system of claim 13, wherein an exterior surface of the central core extends between the first side wall of the first fin and the second side wall of the second fin.

15. The electrical connector system of claim 13, wherein each cantilevered finger is disposed between the first side wall and the second side wall of the slot.

16. The electrical connector system of claim 10, wherein each cantilevered finger is arranged at an angle relative to a longitudinal axis of the first electrical connector, wherein the angle is equal for each cantilevered finger of the plurality of cantilevered fingers.

17. The electrical connector system of claim 10, wherein the gap separating each cantilevered finger from an adjacent cantilevered finger is equal for all cantilevered fingers of the plurality of cantilevered fingers.

18. The electrical connector system of claim 10, wherein the free end of each cantilevered finger of the first connector is spaced apart from a bottom surface of each corresponding slot of the second connector when the first and second connectors are mated.

* * * * *